United States Patent [19]

Uchimoto et al.

[11] Patent Number: 4,922,299

[45] Date of Patent: May 1, 1990

[54] ELECTROSTATIC CHARGE EMITTING APPARATUS

[75] Inventors: Yoshihiro Uchimoto, Habikino; Hirofumi Nakagawa, Osaka, both of Japan

[73] Assignee: Unico Co., Ltd., Japan

[21] Appl. No.: 334,138

[22] Filed: Apr. 6, 1989

[30] Foreign Application Priority Data

Apr. 7, 1988 [JP] Japan ..... 63-84141

[51] Int. Cl.[5] ..... G03G 15/00

[52] U.S. Cl. ..... 355/219; 355/222; 250/325

[58] Field of Search ..... 35/219, 221, 222, 225; 250/324, 325, 326, 423 R, 423 D; 118/620; 328/258, 259, 260

[56] References Cited

U.S. PATENT DOCUMENTS 3,920,992 11/1975 Van den Bogaert et al. ... 250/326 X
3,967,118 6/1976 Sternberg ..... 250/325
4,318,002 3/1982 Pressman et al. ..... 355/291 X
4,426,654 1/1984 Tarumi et al. ..... 250/326 X
4,571,052 2/1986 Shirai ..... 355/219 X
4,803,593 2/1989 Matsumoto et al. ..... 250/326 X

*Primary Examiner*—A. C. Prescott
*Attorney, Agent, or Firm*—Arnold, White & Durkee

[57] ABSTRACT

An electrostatic charge emitting apparatus includes a discharging member having an electrode member, an electrically conductive elastic rubber member having fine conductive particles contained therein and an insulating layer having a number of apertures therein and being formed on the conductive elastic rubber member; and the electrode member is connected to an electric power source and a surface of the insulating layer is urged against a member to be charged or de-charged: and the member to be charged or de-charged is charged or de-charged by discharge in the apertures of the insulating layer generated by emitting electrostatic charge toward the member at a lower threshold voltage and thus the generation of ozone gas can be decreased.

17 Claims, 7 Drawing Sheets

ELECTROSTATIC CHARGE EMITTING APPARATUS

BACKGROUND OF THE INVENTION

FIELD OF THE INVENTION AND RELATED ART STATEMENT

The present invention relates to an electrostatic charge emitting apparatus particularly suitable for use in image forming devices such as electrophotographic copy machine and electrophotographic printer.

In the electrophotographic copy machine or the electrophotographic printer, a plurality of corona chargers are used for electrifying a surface of an image forming member such as a photosensitive drum, for transferring a toner image formed on the photosensitive drum to a recording paper, and for de-charging the charged photosensitive drum in order to separate the recording paper therefrom.

The corona charger mentioned above comprises a corona wire mounted in a shield case; and the wire is connected to a DC power supply. When a voltage of about 6 KV is applied to the wire, an electric field is generated in a space surrounding the corona wire in the shield case; the space is ionized due to the high voltage applied to the corona wire and the ion is discharged toward the image forming member by the force due to the electric field; and a surface of the image forming member such as the photosensitive drum is uniformly charged. Hereinafter, an electrode for generating the electric field such as the corona wire is also represented by a discharging member. However, in the known corona chargers, the corona wire having a diameter of about 60 μm, which is relatively thick, is used and it is necessary to make the distance between the corona wire and the shield case long. To this end, the high electric voltage such as 6 KV has to be applied to the wire and therefore an extremely great amount of ozone gas, which affects the human body, is generated from the corona charger. Thus, it has been required to develop a charge emitting apparatus in which ozone gas is not generated so much.

In order to meet this requirement, a brush charging method has been proposed. In this method, a brush roller on which a plurality of conductive fibers each having a diameter of about 10 μm are planted is used; the brush roller is arranged such that the tip portions of the fibers are made slidably contact with the surface of a photosensitive image forming member; and the photosensitive image forming member is charged by the corona discharge generated at the tip portions of the brushes. In this method, since it is possible to reduce the diameter of the conductive fiber to about 10 μm, the threshold voltage at which discharging starts becomes low and thus the generation of ozone gas can be decreased.

However, this method has some practical disadvantages such that since the conductive fibers planted in the brush roller are slidably contacted with the surface of the photosensitive image forming member, a mechanical stress is strongly effected to the fibers. As a result, in case that the brush is used for a long time, the tip portions of the fibers is transformed so as not to be elastically recovered due to the mechanical stress or the fibers are fallen off. To this end, the tips of the fibers would become not to contact with the photosensitive member evenly, so that the whole surface of the photosensitive image forming member cannot to be charged uniformly. Also, in order to charge the surface of the photosensitive image forming member evenly, it is necessary to strictly control the distance between the tip portions of the fibers and the surface of the photosensitive member. If the fibers are contacted with the photosensitive member strongly, the tips of the fibers will be bent largely, and therefore the tips of the fibers are separated from the surface of the photosensitive image forming member so largely that the electric potential on the surface of the member will be decreased. While, if the contacting amount of the fibers is small, the corona discharge is not generated unequally, so that the electric potential on the surface of the member becomes uneven. Therefore, the setting operation of the brush roller to the surface of the photosensitive image forming member is so complicated. Further, in case the brush roller is used for a long time, a toner on the photosensitive image forming member which has not removed therefrom in a transferring process is adhered to the surface of the brush. As the result, no corona discharge is locally generated, so that the photosensitive image forming member cannot be charged uniformly.

SUMMARY OF THE INVENTION

In order to resolve the disadvantages mentioned above, the present invention has for its object to provide the electrostatic charge emitting apparatus by which the photosensitive member can be charged evenly at a desired potential and the generation of ozone gas can be decreased. Furthermore, the charge emitting apparatus according to the invention has an excellent durability.

According to the invention, the discharging device comprises a discharging member comprising an electrode member and an insulating layer having a number of fine apertures formed therein and being applied on at least a part of a surface of said electrode member;

a supporting member for supporting said discharging member in an insulated manner; and an electric power source means for applying to said electrode member a voltage for generating discharge in the apertures of said insulating layer to emit electrostatic charge toward a member to be charged or decharged.

In a charging method utilizing a gaseous discharge, in order to decrease to generate ozone gas it is required to make the threshold voltage at which discharging starts low. In a corona ion generator of the non-uniform electric field produced by a corona wire, the threshold voltage $V_0$ at which the corona discharge starts is represented by the following experimental equation.

$$V_0 = 31m\ \delta r \cdot \ln(R/r) \cdot (1 + 0.308/\delta r) \quad (1)$$

wherein: m is 1; δ is about 392/273+t; t represents temperature (°C.); r represents a radius of the corona wire (cm); and R represents a radius of the cylindrical shield case.

In the below mentioned preferred embodiments, on the surface of the discharging member there are provided a number of fine projections. And these projections serve as the electrode for generating the electric field for discharging. The experimental equation (1) can be applied not only for the corona ion generator in which the corona wire having a circular cross section is used as the discharge electrode, but also for the corona ion generator in which a projection having a large curvature is used instead of the wire.

The present inventors analyzed the above mentioned equation (1) by several ways, and found that in order to make the threshold voltage lower, it is effective to meet at least one of the following requirements:

(A) make the curvature of the electrode of the discharging member large (B) make the distance between the electrode of the discharging member and an electrode opposite to the discharging member small As stated below in detail, the discharging member for use in the charge emitting apparatus according to the invention has a number of fine projections on the surface of the electrode of the discharging member, the curvatures of the projections are so large that the threshold voltage becomes low.

Further to the above, since the charge emitting apparatus according to the invention comprises the insulating layer having a number of apertures therein on the discharging member, the distance between the projections and the surface of the member to be charged or de-charged can be determined by the thickness of the insulating layer. Thus, it is possible to meet the second requirement easily, so that the threshold voltage can be made low.

DETAILED DESCRIPTION OF THE PREFERRED EMBODIMENTS

Figure 1:
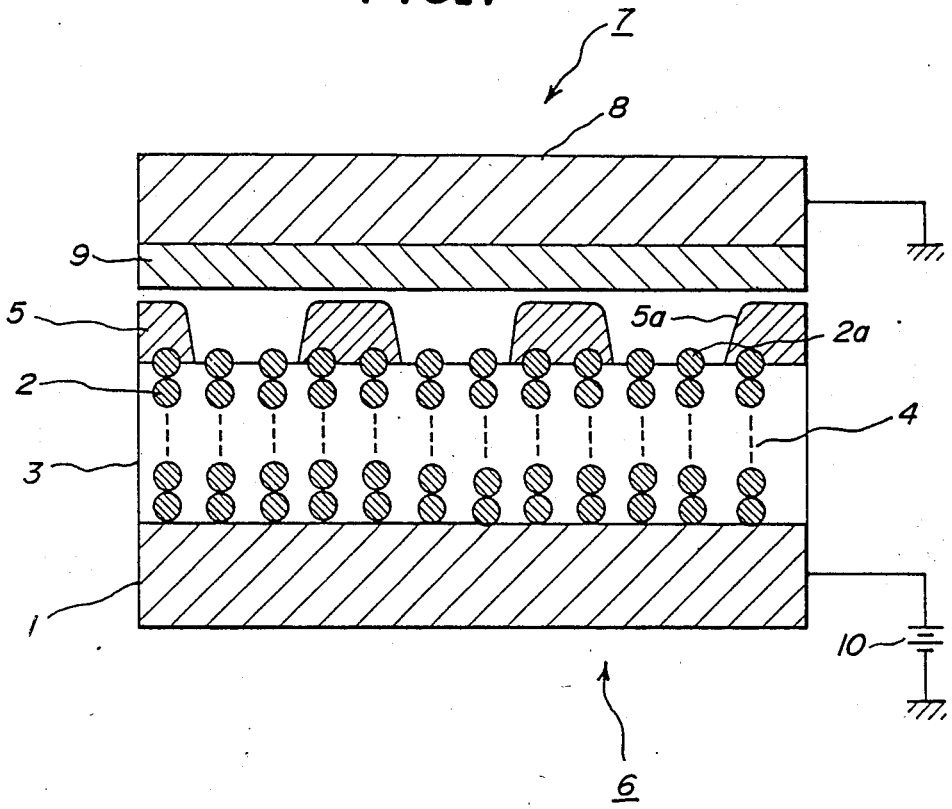
FIG. 1 is a schematic view partially showing the electrostatic charge emitting apparatus according to the invention for explaining the principle of the apparatus.

FIG. 1 is a schematic view partially showing the electrostatic charge emitting apparatus according to the present invention for explaining the principle of the invention. In this charge emitting apparatus, the discharging member 6 comprises a base metal electrode member 1, a conductive rubber layer 3 applied on the electrode member and having a number of carbon particles 2 contained therein, and an insulating layer 5 having a number of apertures 5*a* therein. When a large amount of carbon particles 2 are permeated in the rubber material, chained carbon particles are formed therein. One ends of these chained carbon particles are contacted with the surface of the base metal electrode member 1 and other ends are exposed in the surface of the conductive rubber layer 3 to form a conductivity paths 4 in the rubber layer 3. Since the diameter of the carbon particle 2 is smaller than about 1 μm, in the surface of the conductive rubber layer 3 are formed a plurality of fine z projections 2*a* having a diameter of 1 μm or less of the carbon particles 2. On this conductive rubber layer 3 is formed the insulating layer 5 having a thickness of about 100 μm; and the thus structured discharge member 6 is urged against a surface of a member 7 to be charged or de-charged. In this embodiment, the member 7 is composed of a base drum 8 made by aluminum (Al) and a photosensitive layer 9 formed thereon; further the base drum 8 is connected to the ground. When a voltage for discharging is applied to the base electrode 1 from a high voltage DC power source 10 under the condition that the insulating layer 5 is urged against the surface of the photosensitive layer 9 formed on the base drum 8, gaseous discharge is generated in small spaces within the apertures 5*a* of the insulating layer 5, and the air is ionized by an electric field caused by the discharge and the ion is discharged toward the photosensitive member 7. Such discharge can be called a micro corona discharge. In this case, since the distance between the carbon particles 2 exposed in the surface of the rubber layer 3 and the surface of the photosensitive layer 9 is accurately determined by the thickness of the insulating layer 5, it is possible to make the distance extremely small. Furthermore, in this discharging member, the curvature of carbon particles which serves as a discharging electrode, exposed in the surface of the rubber layer 3, and thus, it is possible to make the threshold voltage at which discharging starts low. And also, as the distance between the discharge electrode and the surface of the member to be charged can be made very small, it is possible to make the potential of the surface of the member to be charged almost equal to that of the voltage applied to the discharge electrode. Further to the above, since the distance between the discharge electrode and the member to be charged is defined by the thickness of the insulating layer 5, the distance can be easily made constant and further it becomes easy to assemble the discharging member to the member to be charged. Moreover, if the base electrode member 1 is connected to a high voltage AC power source, it is possible to use the discharging member for de-charging because the positive and negative electric charges are discharged alternatively in the space of the aperture of the insulating layer.

Figure 2:
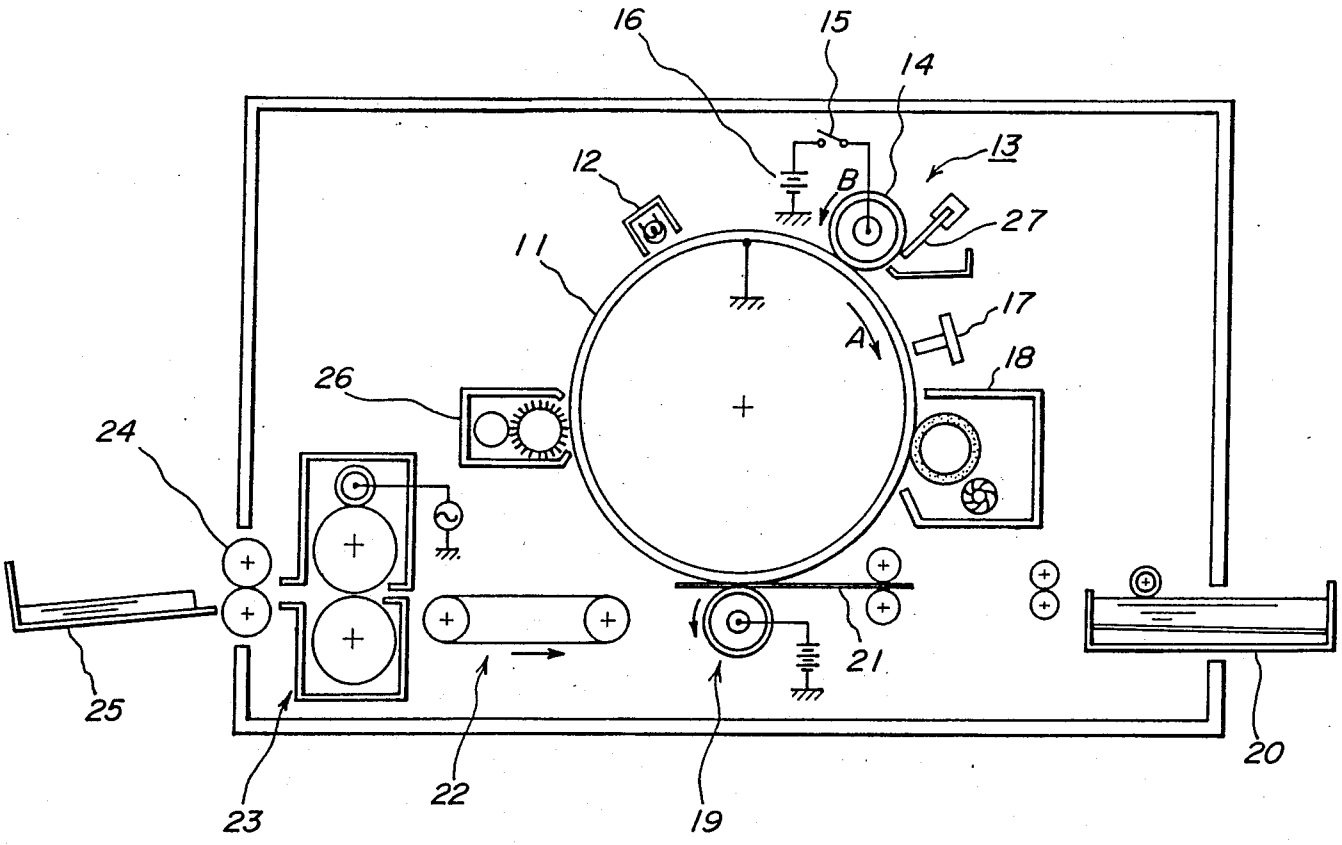
FIG. 2 is a schematic view illustrating an electrophotographic printer in which the electrostatic charge emitting apparatuses according to the invention are used in various ways.

FIG. 2 is a schematic view illustrating an electrophotographic printer in which the electrostatic charge emitting apparatuses according to the invention are used in various ways.

A photosensitive drum 11 to be charged is rotatably arranged in the printer and is rotated in a direction shown by an arrow A. The photosensitive drum 11 comprises a cylindrical base member made by aluminum and a layer of selenium or an organic photosensitive material coated on the circumferential surface of the base member; and the base member is connected to the ground. Around over the photosensitive drum 11, there are arranged a charger 13, an exposing device 17, a developing device 18, a transferring device 19, a cleaning device 26 and an eraser lamp 12 in this order, and a toner fixing device 23 is further arranged in the electrophotographic printer.

The all surface of the photosensitive drum 11 is de-charged by an eraser lamp 12, thereafter the surface of the drum 11 is evenly charged for example at 600 V by the charger 13 in which the charge emitting apparatus according to the invention is provided. The charger 13 comprises a roller 14 including a conductive member and an insulating layer formed on the outer surface thereof; and the roller 14 is connected to a high voltage DC power source 16 via a switch 15. The roller 14 is rotated in a direction shown by an arrow B while the surface thereof is slidely contacted with the surface of the photosensitive drum 11. When the surface of roller 14 is contacted with the photosensitive drum 11, the gaseous discharge is generated in the spaces within the apertures of the insulating layer formed on the roller 14; and thus, the surface of the photosensitive drum 11 is evenly charged.

After charged by the charger 13, the drum 11 is rotated in the direction shown by the arrow B and the surface of the photosensitive drum 11 is exposed by an exposing device 17, in which an LED array is installed, to form an electrostatic latent image thereon. Thereafter, the electrostatic latent image is developed by a developing device 18 to form a toner image.

The thus formed toner image is printed on a recording paper 21 which is conveyed from a paper supply cassette 20 to a position at which printing is conducted by the transferring device 19. The paper supply cassette 20 conveys the recording paper 21 simultaneously with the rotation of the photosensitive drum 11. Thereafter the recording paper 21 on which the toner image has been formed is conveyed by means of a conveyer 22 to a position where a heat roller 23 is arranged. After the toner image is fixed on the recording paper 21 by the heat roller 23, the recording paper is exhausted onto a tray 25 via paper exhausting rollers 24.

On the other hand, the photosensitive drum 11 is further rotated and the toner still remained on the surface of the photosensitive drum 11 is removed by the cleaning device 26. Thereafter, all of the surface of the photosensitive drum 11 is de-charged by the eraser lamp 12 again. There is an instance that some toner is still adhered on the surface of photosensitive drum even after the surface is cleaned by the cleaning device 26. In such case, the remaining toner is transferred to the roller 14 of the charger 13 when the surface of the drum 11 is contacted with the roller 14. In order to avoid the disadvantage, a scraper 27 having a shape such like an elastic blade is arranged and urged against the surface of the roller 14 to scratch the unnecessary toner. Therefore, the surface of the roller 14 can be always kept clean. The insulating layer formed on the surface of the roller 14 has a high mechanical intensity, so that the surface of the roller 14 is not harmed by urging the scraper 27 thereon. In this case, it is desired to use an insulating material having a small friction coefficient such as fluorine resin for the insulating layer. It should be noted that this insulating layer also serves to protect the base electrode member of the roller 14.

The charge emitting apparatus according to the invention can be also applied to the developing device 18, transferring device 19, and the heat roller 23 in the electrophotographic printer shown in FIG. 2.

Figure 3:
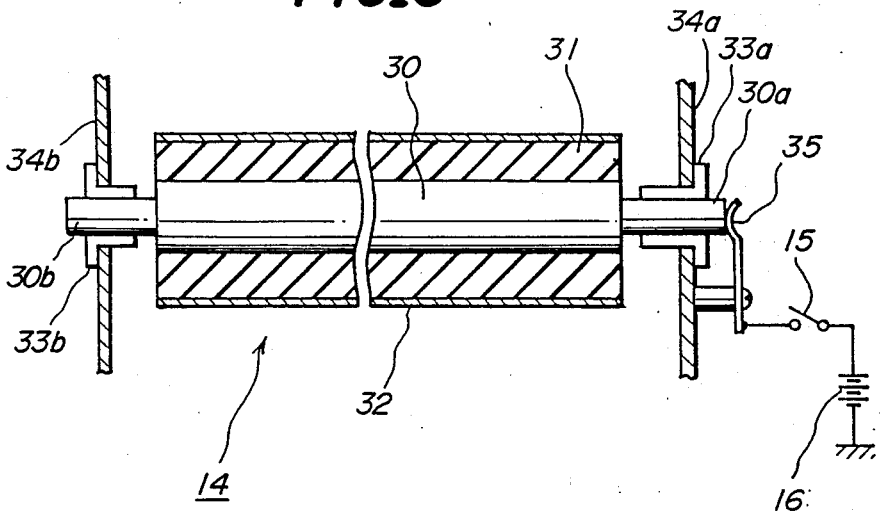
FIG. 3 is a schematic cross-sectional view depicting a first embodiment of the charge emitting apparatus according to the present invention.

FIG. 3 is a schematic cross sectional view showing the first embodiment of the charge emitting apparatus according to the invention which is used in the charger shown in FIG. 2. a conductive elastic rubber layer 31 having a thickness of 5 mm formed on the circumferential surface of the shaft 30, and an insulating layer 32 having a thickness of several 10 μm formed on the conductive rubber layer 31. An elastic rubber material, such as natural rubber, silicon rubber, NBR rubber, croroplane rubber or polyurethane rubber, into which conductive fine powder such as carbon, copper, aluminum or tungsten, etc. is mixed to form conductive paths in the rubber layer 31, can be used for the conductive rubber layer 31. It is desired to make the diameter of the conductive fine powder lower than several micronmeters, particularly desired to use the fine powder having a size smaller than the size of the apertures formed in the insulating layer 32. Since the conductive fine powder is mixed in the rubber material, the conductive fine powers are exposed on the surface of the rubber layer, and thus fine projections are formed on the surface of the rubber layer 31 and exposed into the air space in the apertures of the insulating layer 32 without conducting special fine processing or grinding processing on the surface of the roller 14.

Instead of the fine powder, it is possible to form conductive path in the rubber layer 31 by embedding conductive fine fibers therein. In this case, the conductive fine fibers per se form the conductivity path and the tip end portions of the fibers are exposed into the aperture. Therefore, a discharge electrode having a fine diameter can be formed on the surface of rubber layer without dealing a special process.

There are several ways for forming the conductive rubber layer 31 on the metal roller shaft 30. In the present embodiment, an adhesive layer (not shown) is formed between the roller shaft 30 and the conductive rubber layer 31 to secure the rubber layer 31 on the roller shaft 30.

The insulating layer 32 is made by an electric insulating material such as polyester, polyvinyl chloride, polyethylene, polypropylene, nylon epoxy resin or fluorine resin. In order to form fine apertures in the insulating layer 32, the following steps are necessary: the first step is solving an insulating resin in a solvent; the second is applying this on a conductive rubber layer and third is volatilizing the solvent applied on the conductive rubber layer. It is desired to make the diameter of the apertures 10 μm or less, preferably several μm or less.

Both ends **30*a* and 30*b* of the metal shaft 30 are rotatably supported by supporting frames 34*a* and 34*b*, via electric insulated bearings 33*a* and 33*b*, respectively. The one end of the metal shaft 30*a* is connected to a high voltage DC power supply 16 via a brush connecting member 35 and a switch 15. When the roller 14 is urged against the surface of the member to be charged 11, the conductive rubber layer 31 is elastically deformed thereby and thus the insulating layer 32 is urged against the photosensitive layer of the member to be charged 11 in an intimate manner. On the other hand, in apertures formed in the insulating layer 32, air spaces are formed. When the discharge voltage is applied upon the conductive rubber layer 31 via the metal roller shaft 30, the gaseous discharge is generated in the small air space within the apertures of the insulating layer 32. At this time, an electric field is formed in the space between the conductive rubber layer 31 and the base electrode of the member to be charged 11; the corona ion is discharged toward the surface of the member 11 through the fine apertures of the insulating layer 32 by this electric field; and thus the surface of the member to be charged 11 is charged up to a desired electric potential. In this case, since the gaseous discharging is kept until the potential of the surface of the member to be charged 11 becomes almost equal to that of the discharge voltage of the discharging member, the potential of the surface of the member to be charged 11 becomes almost equal to that of the discharge voltage. Therefore, the discharge current is almost equal to the current of electric charge emitted towards the member to be charged in the air space of the apertures of the insulating layer 32** and thus, the discharge current can be utilized efficiently and the consumption of electric power can be saved.

The charge region formed on the surface of photosensitive layer of the member to be charged is determined by the diameter and the number of the apertures formed in the insulating layer 32. However, the average diameter of the toner particles is 10 μm or more, while the apertures each having a diameter of several μm are formed in the insulating layer at about 30% in the square ratio. Therefore it never affects the resolution of the toner image. Particularly, in case the toner fixing devices, in which the heat roller is used for fixing the toner image to the recording medium is used, the toner adhered on the recording medium is enlarged during the toner fixing process and thus there is no occasion that white portion is formed on the image printed on the recording medium. Particularly, in the electrophotosensitive printer, since the line image is reproduced in a dotted manner, the resolving power of the reproduced image is determined by that of the exposuring device, thus there is no problem when the image is reproduced on the recording medium.

Furthermore, the roller 14 is always electrically insulated from the member to be charged 11 by the insulating layer 32. Therefore, if a flaw such as pin hole exists on the surface of the member to be charged 11, it is possible to prevent the generation of a breakdown efficiently.

Moreover, if the toner is still adhered to the surface of the roller 14, it is possible to remove the remained toner only by urging the scraper 27 against the surface of the roller 14 and the apertures of the insulating layer 32 are not filled with the toner powders, because the diameter of the toner particle is larger than that of the aperture.

Figure 4A:
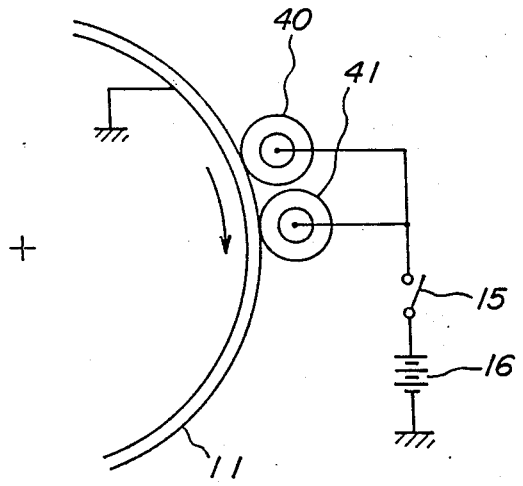
FIGS. 4A and 4B are schematic views representing the second and third embodiments of the charge emitting apparatus according to the present invention.
Figure 4B:
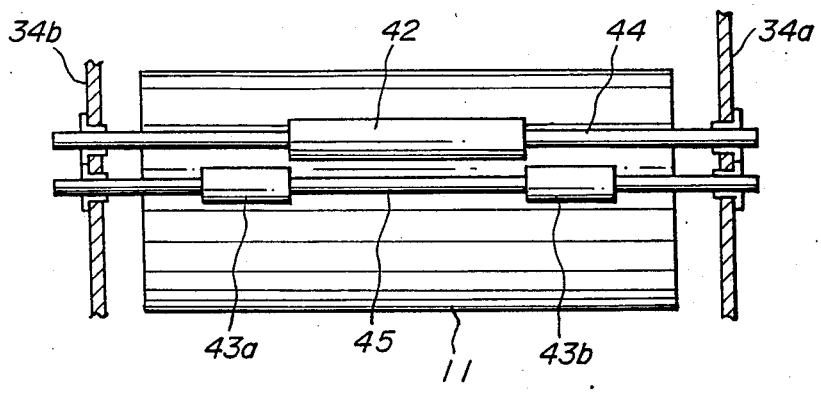

FIGS. 4A and 4B are schematic views representing second and third embodiments of the charge emitting apparatus according to the present invention.

In the second embodiment, shown in FIG. 4A, there are provided first and second rollers 40 and 41 one after the other with respect to the relative moving direction of the rollers 40 and 41 and the member to be charged. Since in this apparatus there are arranged successively two rollers, even if the surface of the member to be charged 11 is not charged completely by the first roller 40, the non-charged portion can be charged by the second roller 41. Therefore, the whole surface of the member to be charged 11 can be charged in a more dense manner.

In the third embodiment of the charge emitting device shown in FIG. 4B, there are also provided first and second rollers 42 and 43*a* and 43*b*, which are shifted from each other with respect to the direction perpendicular to the relative moving direction of the rollers and the member to be charged. In this embodiment, it is possible to vary the width of roller in accordance with the width of the image to be reproduced. That is to say, as shown in FIG. 4B, the first roller 42 and the second rollers 43*a* and 43*b* are arranged on different metal shafts 44 and 45, which are supported by the supporting plates 34*a* and 34*b* being made parallel with each other via insulated bearings 33*a* and 33*b*, respectively. The first roller 42 has its a width of 210 mm (A-4 size in JIS standard) and each of the second rollers 42*a* and 43*b* has its width of 44 mm. In case the width of the image to be reproduced is A-4 size, only the first roller 42 is made ON, while if the width of the image to be reproduce is A-3 size, both of the first and second rollers 42 and 43*a* and 43*b* are made ON. According to such structure, it is possible to charge only the desired width of the discharging member in accordance with the width of image to be reproduced. This is particularly effective to use in the enlargeable copy machine.

Figure 5A:
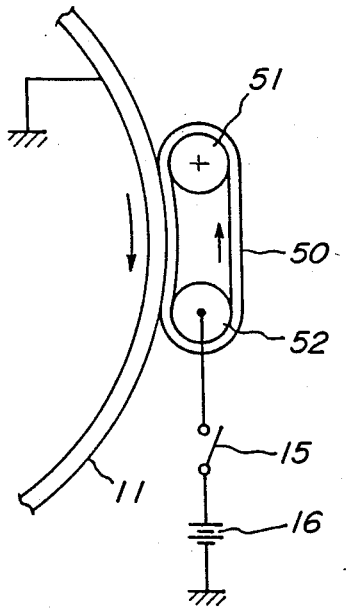
FIGS. 5A and 5B are schematic views showing the fourth and fifth embodiments of the charge emitting apparatus according to the present invention.

FIG. 5A is a schematic view showing the fourth embodiment according to the invention. In this embodiment, an endless belt 50 is used for charging the photosensitive drum 11 instead of the roller. The belt 50 comprises a conductive elastic belt member and an insulating layer formed thereon and is extended over supporting rollers 51 and 52. The belt 50 is supported by the supporting rollers 51 and 52 so as to be urged against the surface of the photosensitive drum 11 and the supporting rollers 51 and 52 are secured to supporting shafts via insulated bearings (not shown) in an electrically insulated manner. While, the supporting roller 52 is connected to a high voltage DC power source 16 via switch 15. By using the belt for charging the drum 11, it is possible to make the contacting length between the belt 50, which serves as a discharging member, and the surface of the photosensitive drum 11 so long that the charging time becomes longer.

In this case, it is not necessary to make identical the running velocity of the belt 50 with the rotating velocity of the photosensitive drum 11. When the running velocity of the belt 50 is not identical with the rotating velocity of the photosensitive drum 11, the area of the surface of the photosensitive drum 11 which is opposed to the apertures of the insulating layer of the belt 50 would be increased, and thus the non-charged area of the photosensitive drum 11 would be decreased. It may be arranged such that the photosensitive drum 10 is rotated against the stopped belt 50.

Figure 5B:
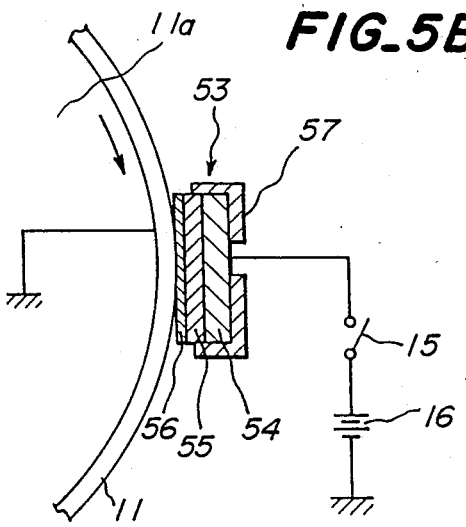

FIG. 5B is a schematic view illustrating fifth embodiment of the charge emitting apparatus according to the invention. In this embodiment, a discharging member 53 is fixed to a housing 57 and the photosensitive drum 11 is rotatably urged thereagainst. The discharging member 53 comprises a metal electrode member 54 having the same width as that of the image to be reproduced, a conductive elastic rubber layer 55 formed on the metal electrode member 54, and an insulating layer 56 formed on the rubber layer 55. The housing 57 supports the discharging member 53 so as to urge the surface of the insulating layer 56 against the surface of the photosensitive drum 11. In such construction, the setting operation becomes easy and the structure of the apparatus becomes simple.

In this embodiment, it is also possible to form a desired nip width by utilizing the nature of elastic deformation of the conductive elastic rubber layer 55, as the result, a desired charging time can be obtained.

Figure 6:
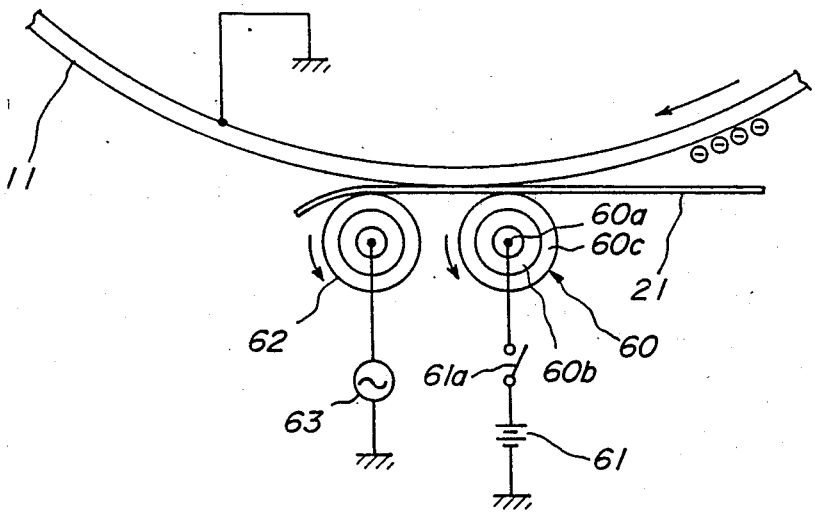
FIG. 6 is a schematic view depicting a sixth embodiment of the charge emitting apparatus according to the invention which is formed as a transferring device installed in the electrophotographic printer shown in FIG. 2.

FIG. 6 is a schematic view depicting the sixth embodiment of the charge emitting apparatus according to the invention which is used in the transferring device shown in FIG. 2. A roller 60 is rotatably arranged so as to be urged against the photosensitive drum 10 via a recording paper 21. The charging roller 60 comprises a metal roller shaft 60*a*, which serves as an electrode, a conductive elastic rubber layer 60*b* formed on the circumferential surface of the shaft, and an insulating layer 60*c* formed on the rubber layer 60*b* and is rotatably supported by a supporting member (not shown) via insulated bearings (not shown). A recording paper 21 is conveyed to the position where the charging roller 60 is arranged simultaneously with the image forming operation, and is inserted between the photosensitive drum 11 and the charging roller 60. Simultaneously with the inserting operation of the recording paper 21, a positive discharge voltage is applied from the high voltage DC power source 61, which is connected to the metal roller shaft 60*a* via the switch 61*a*. The base 11*a* made by aluminum of the photosensitive drum 11 serves as an opposite electrode and there is produced a strong electric field between the charging roller 60 and the Al base, so that the positive electric charge is discharged to the recording paper 21 from the charging roller 60. As a result, on the backside of the recording paper (the side not opposed to the photosensitive drum 11), the positive electric charge is deposited and a strong transferring electric field is formed between the recording paper 21 and the Al base 11*a* of the photosensitive drum 11. The toner particles adhered on the photosensitive drum are transferred onto the recording paper 21 by the transferring electric field. In this case, the voltage 2500 V of the power source 61 is enough to obtain a desired transferring force.

In this embodiment, a de-charging roller 62 is further provided in the downstream of the transferring device. The de-charging roller 62 has the same construction as that of the charging roller 60 but is connected to a high voltage AC power source 63 so as to apply an alternate voltage upon the de-charging roller 62. Therefore, positive and negative corona electric charges are discharged from the de-charging roller 62 to the surface of the photosensitive drum 11 alternatively. The corona electric charge serves to de-charge the electric charge on the backside surface of the recording paper 21, so that the recording paper 21 can be separated from the photosensitive drum 11 easily. In this case, it is possible to use a high voltage power source which generates an AC voltage superimposed on a DC voltage. Furthermore, the scrapers may be urged against the charging roller 60 and the de-charging roller 62 in order to remove the toner particles adhered to the surfaces of these rollers.

Figure 7:
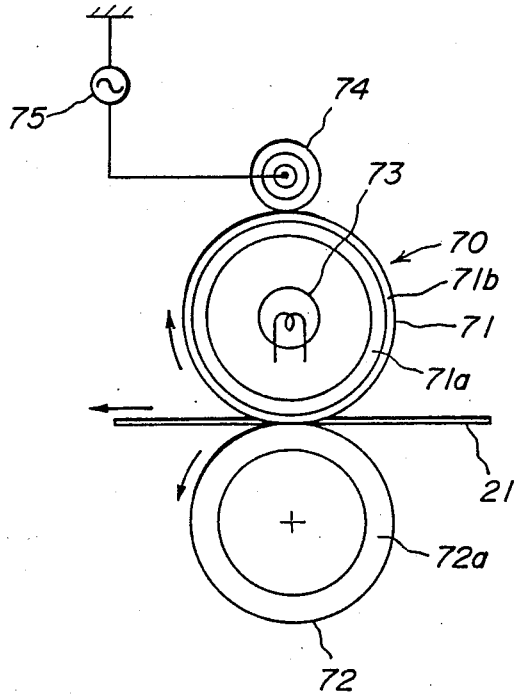
FIG. 7 is a schematic view representing the seventh embodiment of the charge emitting apparatus according to the invention which is formed as a decharging device installed in the electrophotographic printer shown in FIG. 2.

FIG. 7 is a schematic view representing the seventh embodiment of the charge emitting apparatus according to the invention which is used in the decharging device shown in FIG. 2.

In the charge emitting apparatus being formed as a toner fixing device according to the invention, there is also utilized the gaseous discharging. Therefore, if the discharging member is connected to a high voltage AC power source, positive electric charge and negative electric charge are alternatively discharged to the photosensitive drum, and thus positive or negative electric charge charged on an insulating material is effectively removed. Therefore, if the discharging member of the charge emitting apparatus according to the invention is connected to a high voltage AC power source and the insulating layer is urged to the insulating material to be de-charged, the apparatus works as the de-charging device.

The toner fixing device 70 comprises a heat roller 71 consisting of a hollow metal base 71*a* made by aluminum and a fluorine resin layer 71*b* coated on the circumferential surface thereof, and a backup roller 72 on which a silicon rubber layer 72*a* is coated; and the heat roller 71 and the backup roller 72 are urged to each other. In an inner space of the heat roller 71, there is provided a heater 73 such as halogen lamp to heat the heat roller 71 up to a predetermined temperature. During the recording paper 21 on which non-fixed toner image has been transferred, passes through a nip portion between the heat roller 71 and backup roller 72, the toner image on the recording paper 20 is melt and fixed thereto. In this toner fixing device 70, since the fluorine resin 71*b* coated on the circumferential surface of the heat roller 71 and the silicon rubber layer 72*a* coated on the surface of the backup roller 72 are insulating material, when the heat roller 71 is rotated, there is generated a friction charge up to for example, 1000 V or more between the heat roller 71 and the backup roller 72. If the charge has a polarity opposite to that of the toner, the toner on the recording paper 21 is transferred to the surface of the heat roller 71 by the static force according to the charge; as the result, an undesirable offset phenomenon is caused. In order to avoid the undesirable offset phenomenon, a de-charging device 74 having the same construction as that of the de-charging device shown in FIG. 6 is arranged on the heat roller 71 and removes the electric charge deposited on the heat roller 71. The de-charging roller 74 is rotatably arranged so as to be urged against the heat roller 71 and is connected to the high voltage AC power source 75. In the contacting area where the de-charging roller 74 and the heat roller 71 are contacted with each other, the hollow metal base 71*a* serves as an electrode opposite to the discharge electrode of the de-charging roller 74, and thus the distance between the discharge electrode and the electrode opposite thereto is made so small that an alternate corona discharge is generated in the apertures formed in the insulating layer of the de-charging roller 74 and positive and negative charges are alternatively discharged to the heat roller 71. As the result, the electric charge generated by the friction caused by the heat roller 71 and the backup roller 72 is disappeared and the thus electric charge of the surface of the heat roller 71 is always maintained at 0 V. Instead of the de-charging roller 74, a plate-like discharging member, such as shown in FIG. 5B, may be used to de-charge the heat roller. In this case, the discharging member should be connected to the high voltage AC power source. The plate-like de-charging device as mentioned above can be used to de-charge not only the heat roller 71 but also several kinds of insulating members such as the photosensitive drum 11 or the charging roller 60 used in the transferring device shown in FIG. 6.

Figure 8A:
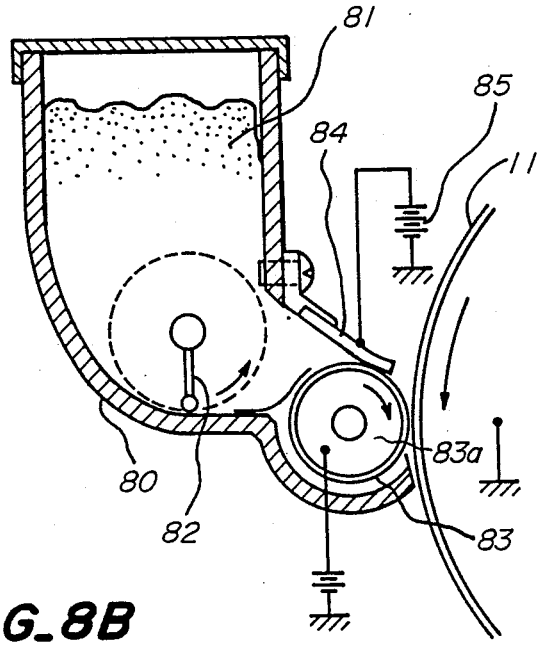
FIGS. 8A and 8B are schematic views showing the eighth and ninth embodiments of the charge emitting apparatus according to the invention which are formed as a developing device installed in the electrophotographic printer shown in FIG. 2.
Figure 8B:
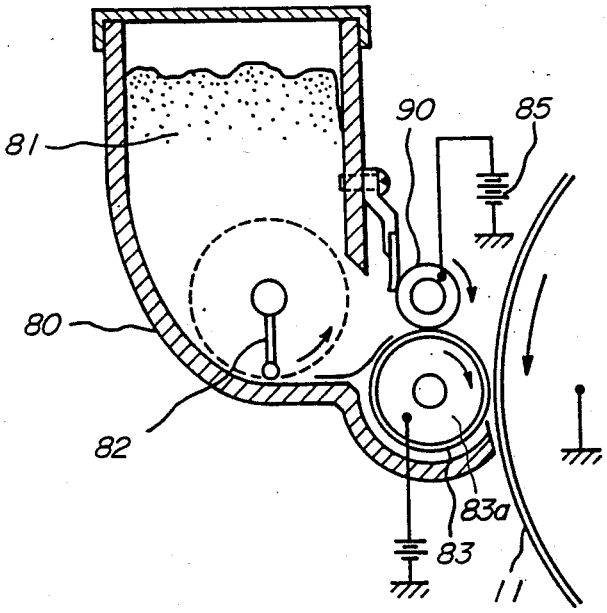

FIGS. 8A and 8B are schematic views showing eighth and ninth embodiments of the charge emitting apparatus according to the invention which is used in the developing device. In the developing device, a non-magnetic mono-component developing agent is used to develop the electrostatic latent image formed on the drum 11, i.e. an insulated toner is charged by the charging device according to the invention.

As shown in FIG. 8A, a toner housing 80 is arranged so as to be opposite to the photosensitive drum 11. In this housing 80 there is provided insulating toner 81 which is supplied to a developing roller 83 by rotating a toner supplying bar 82 in a clockwise direction. In the developing roller 83, which is made by aluminum, is provided a hollow sleeve 83*a;* and on the circumferential surface of the developing roller 83, a sandblasting is treated. Against the developing roller 83 is urged the plate-like discharging member 84 having the same structure of the discharging member 53 shown in FIG. 5B, and the discharging member 84 is connected to a high voltage DC power supply 85. As same as the discharging member 53, the discharging member 84 comprises a metal electrode member and a conductive elastic rubber layer formed thereon and a insulating layer formed on the rubber layer and is so arranged that the insulating layer is urged against the surface of the developing roller 83. The toner supplied to the developing roller 83 received in fine concaved portions formed in the circumferential surface of the developing roller 83 and is transferred to the position at which the developing roller 83 is opposite to the discharging member 84 in accordance with the rotation of the developing roller 83. And after the toner received in the concaved portion contacted with the discharging member 84, a toner layer having a uniform thickness is formed on the surface of the developing roller 83. During the toner received in the concaved portions is passed through the nip between the discharging member 84 and the developing roller 83, the toner layer is charged by the discharging member 84. The electric charge having a polarity opposite to that of the toner is introduced on the developing roller 83 by a static induction effect; and the attracting force existing between introduced charge and the toner charge serves to keep the toner particles on the developing roller 83. The charged toner is further transferred to the position opposite to the photosensitive drum 11 being kept on the developing roller 83 and thereafter the electrostatic latent image formed on the photosensitive drum 11 by the exposuring device is visualized by the toner.

In the ninth embodiment shown in FIG. 8B, a roller-like discharging member 90 is used instead of the plate type discharging member 84. The discharging roller 90 is arranged at the position faced to the developing roller 83 and is rotated in the same direction as the rotating direction of the developing roller 83. The toner supplied to the developing roller 83 is charged at the position faced to the discharging roller 90 by the discharging member of the roller 90 and kept on the developing roller 83 by means of the static induction effect. And the static latent image formed on the photosensitive drum 10 is visualized.

As stated above, since the charge emitting apparatus according to the invention can be used for charging the toner, a non-magnetic mono-component developing device can be realized.

The present invention is not limited to the embodiments mentioned in the above but various modifications and variations could be made. For example, in the above mentioned embodiments, the photosensitive member is charged by directly urging it against the discharging member, but a positioning member such as a color may be used to make a space having a thickness of about 100 μm between the surface of the insulating coated layer of the discharging member and the surface of the photosensitive member.

Further, in the above embodiments, the discharging member comprises the base electrode member, the conductive elastic rubber layer and the insulating layer, but it is possible to form the insulating layer directly on a metal electrode member on the circumferential surface of which fine projections are formed. The charging member having such structure is particularly useful for the flexible or deformable member to be charged.

According to the invention, various advantages can be obtained as follows:

(1) Since use is made of electrode member, on which the insulating layer is formed, the distance between the discharge electrode and the surface of the member to be charged can be made so small. Therefore, the threshold voltage at which discharging starts becomes low, so that an amount of generating ozone gas can be materially decreased. Furthermore, since on the surface of the discharge electrode there are provided fine projections, the threshold voltage becomes lower.

(2) Since the distance between the discharge electrode and the surface of the member to be charged can be controlled by the thickness of the insulating layer, the member is charged up to the same potential as the discharge voltage.

(3) Since the distance between the discharge electrode and the surface of the member to be charged can be determined by the thickness of the insulating layer, the setting of the member becomes easy.

(4) In case the discharging member has roller-like body, the surface of the discharging member can be cleaned only by urging the scraper thereagainst.

(5) Since the almost all parts of the charge discharged from the discharge electrode are used for charging, the discharge current becomes extremely small, so that the electric power consumption can be decreased.

(6) Since the insulating layer formed on the electrode member serves as an insulator for isolating the member to be charged from the discharge electrode, the breakdown can be prevented. For example, it can be prevent to generate a direct flashover between the base of the photosensitive drum and the discharge electrode of the charging member. Therefore, even if there exists a pin hole in the surface of the photosensitive drum, the generation of the breakdown can be effectively prevented.

What is claimed is:

1. An electrostatic charge emitting apparatus comprising:

a discharging member comprising an electrode member and an insulating layer having a number of fine apertures formed therein and being applied on at least a part of a surface of said electrode member;

a supporting member for supporting said discharging member in an insulated manner; and an electric power source means for applying to said electrode member a voltage for generating discharge in the apertures of said insulating layer to emit electrostatic charge toward a member to be charged or de-charged.

2. An electrostatic charge emitting apparatus according to claim 1, wherein:

a number of fine projections having a size smaller than the size of the aperture of the insulating layer are formed in the circumferential surface of said electrode member.

3. An electrostatic charge emitting apparatus according to claim 2, wherein:

said electrode member is made by metal material.

4. An electrostatic charge emitting apparatus according to claim 2, wherein:

said electrode member comprises a conductive elastic material layer having fine conductive particles contained therein.

5. An electrostatic charge emitting apparatus according to claim 1, wherein:

said discharging member has a roller-shaped body and is rotatably supported by said supporting member.

6. An electrostatic charge emitting apparatus according to claim 5, further comprising a scraper which is slidably contacted with the surface of said insulating layer.

7. An electrostatic charge emitting apparatus according to claim 1, wherein:

said electric power source means generates an AC voltage.

8. An electrostatic charge emitting apparatus according to claim 1, wherein:

said electric power source means generates an AC voltage superimposed on a DC voltage.

9. An electrostatic charge emitting apparatus according to claim 1, wherein:

said electrostatic charge emitting apparatus comprises first and second discharging members which are arranged one after the other viewed in the relative moving direction of the discharging member and the member to be charged or de-charged.

10. An electrostatic charge emitting apparatus according to claim 1, wherein:

said electrostatic charge emitting apparatus comprises a plurality of discharging members which are shifted from each other with respect to the direction perpendicular to the relative moving direction of the discharging members and the member to be charged or decharged and said electric power source means is constructed such that said discharging members can be selectively energized with the electric power.

11. An electrostatic charge emitting apparatus according to claim 1, wherein:

said discharging member has a belt-shaped body.

12. An electrostatic charge emitting apparatus according to claim 1, wherein:

said discharging member has a plate-shaped body.

13. An electrostatic charge emitting apparatus for use in an electrophotographic image forming machine comprising a photosensitive image bearing member, a charger, an exposuring device, a developing device, a transferring device, a cleaning device, a de-charging device and an image fixing device, out of them, the charger, the exposuring device, the developing device, the transferring device, the cleaning device and the de-charging device being arranged around over the circumferential surface of the photosensitive image bearing member in this order, according to claim 1, wherein:

said apparatus is formed as said charger; and said discharging member has a drum-shaped body, said electrode member is connected to said electric power source means generating a DC voltage and said surface of the discharging member is urged against said photosensitive image bearing member.

14. An electrostatic charge emitting apparatus for use in an electrophotographic image forming machine comprising a photosensitive image bearing member, a charger, an exposuring device, a developing device, a transferring device, a cleaning device, a de-charging device and an image fixing device, out of them, the charger, the exposuring device, the developing device, the transferring device, the cleaning device and the de-charging device being arranged around over the circumferential surface of the photosensitive image bearing member in this order, according to claim 1, wherein:

said apparatus is formed as said developing member; and said discharging member has a drum-shaped body, said electrode member is connected to said electric power source means generating DC voltage and said surface of the discharging member is urged via a toner against a developing roller installed in the developing device, and thereby the charged toner is adhered on the developing roller and is made contact with an electrostatic latent image formed on the photosensitive image bearing member.

15. An electrostatic charge emitting apparatus for use in an electrophotographic image forming machine comprising a photosensitive image bearing member, a charger, an exposuring device, a developing device, a transferring device, a cleaning device, a de-charging device and an image fixing device, out of them, the charger, the exposuring device, the developing device, the transferring device, the cleaning device and the de-charging device being arranged around over the circumferential surface of the photosensitive image bearing member in this order, according to claim 1, wherein:

said electrostatic charge emitting apparatus is formed as said transferring device; and discharging member has a drum-shaped body, said electrode member is connected to said electro power source means generating DC voltage and the surface of said discharging member is urged via a recording paper against the surface of the photosensitive image bearing member to transfer a toner image formed on the surface of the photosensitive image bearing member to the recording paper.

16. An electrostatic charge emitting apparatus for use in an electrophotographic image forming machine comprising a photosensitive image bearing member, a charger, an exposuring device, a developing device, a transferring device, a cleaning device, a de-charging device and an image fixing device, out of them, the charger, the exposuring device, the developing device, the transferring device, the cleaning device and the de-charging device being arranged around over the circumferential surface of the photosensitive image bearing member in this order, according to claim 1 or 2, wherein:

said electrostatic charge emitting apparatus is arranged in said image fixing device; and said discharging member has a drum-shaped body, said electrode member is connected to said electric power source means generating AC voltage and said surface of the discharging member is urged against a heat roller installed in the image fixing device to de-charge the surface of the heat roller.

17. An electrostatic charge emitting apparatus for use in an electrophotographic image forming machine comprising a photosensitive image bearing member, a charger, an exposuring device, a developing device, a transferring device, first and second de-charging devices, a cleaning device and an image fixing device, out of them, the charger, the exposuring device, the developing device, the transferring device, the first de-charging device, the cleaning device and the second de-charging device being arranged around over the circumferential surface of the photosensitive image bearing member in this order, according to claim 1, wherein:

said electrostatic charge emitting apparatus is formed as the first de-charging device; and said discharging member has a drum-shaped body, said electrode member is connected to said electric power source means generating AC voltage and the surface of the discharging member is urged against a backside of a recording paper, on which no toner is adhered, and de-charge the electrostatic charge on the photosensitive image bearing member in order to peel the recording paper from the photosensitive image bearing member.

* * * * *